United States Patent [19]

Dowse

[11] 4,009,580

[45] Mar. 1, 1977

[54] UNDERWATER STRUCTURE

[75] Inventor: Brian Edward Wesley Dowse, Reading, England

[73] Assignee: Golder Hoek and Associates Limited, Maidenhead, England

[22] Filed: May 22, 1975

[21] Appl. No.: 579,905

[52] U.S. Cl. ..... 61/88; 61/50

[51] Int. Cl.[2] ..... E02D 27/22; E02D 27/52

[58] Field of Search ..... 61/50, 46, 52, 1 R

[56] References Cited

UNITED STATES PATENTS

| | | | |
|---|---|---|---|
| 3,793,845 | 2/1974 | Keith | 61/46 |
| 3,798,912 | 3/1974 | Best et al. | 61/46 |

FOREIGN PATENTS OR APPLICATIONS

| | | | |
|---|---|---|---|
| 1,136,178 | 12/1968 | United Kingdom | 61/50 |

*Primary Examiner*—Robert L. Wolfe
*Assistant Examiner*—Alex Grosz

[57] ABSTRACT

A method of forming an underwater structure includes the steps of floating to the site an assembly consisting of a floatable structure and an impervious membrane attached to the structure, extending the membrane to cause a base portion to rest on the river or sea bed, filling the membrane with a body of particulate material such as sand, draining the particulate body to enable the external water pressure to render the body coherent, and supporting the floatable structure on the coherent body.

6 Claims, 4 Drawing Figures

UNDERWATER STRUCTURE

This invention relates to underwater structures and in particular to underwater structures such as breakwaters or islands providing above water temporary or permanent working areas.

According to the invention, there is provided a method of forming an underwater structure, comprising the steps of attaching an impervious membrane to the periphery of a floatable structure to form an assembly; extending the membrane, when the assembly is positioned at the site where the underwater structure is to be formed, to cause a base portion of the membrane to rest on the river or sea bed; filling the membrane with a body of non-settable particulate material; draining the particulate body to enable the external water pressure to exert a confining pressure on the body to render it coherent; and supporting the structural unit on the coherent particulate body.

Figure 1:
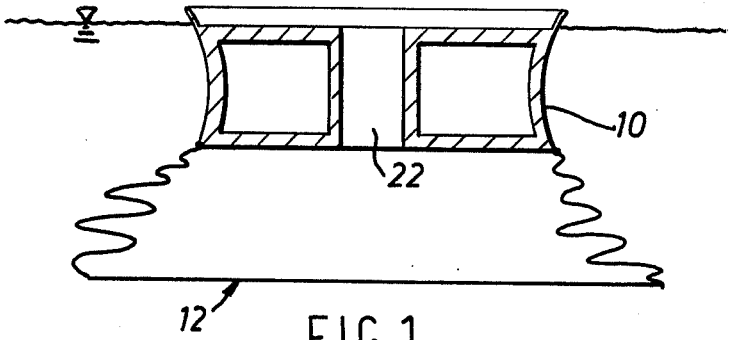
Figure 2:
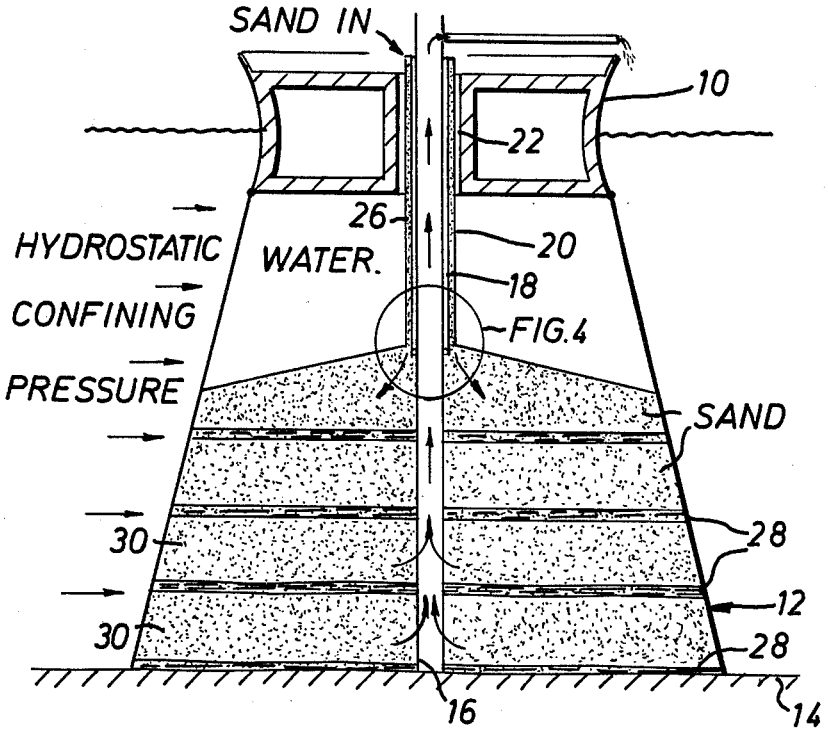
Figure 3:
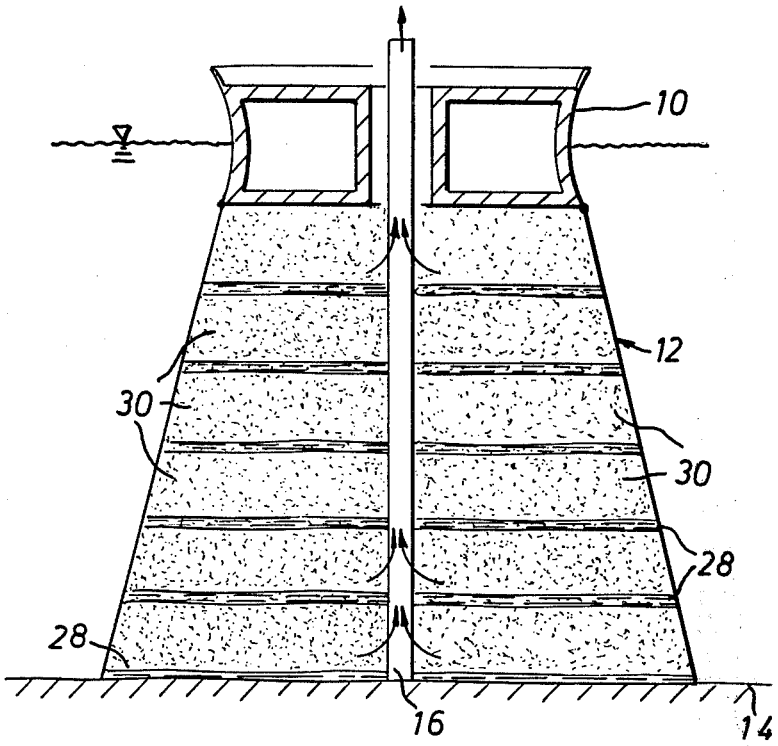
Figure 4:
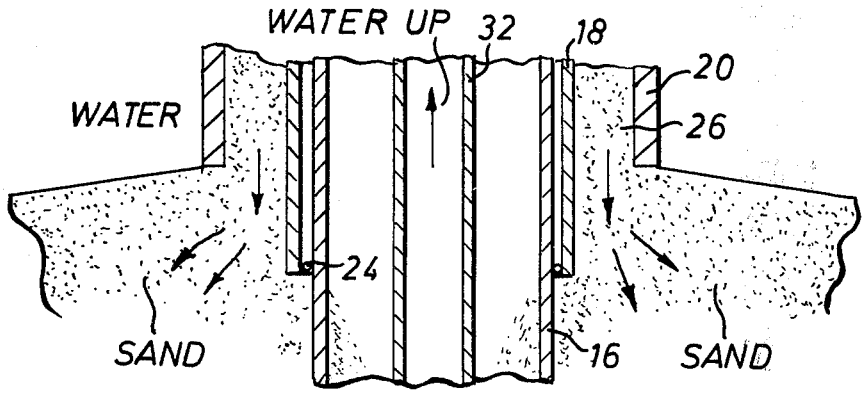

An embodiment of the invention will now be described by way of example only with reference to the accompanying drawings, in which;

FIGS. 1 to 3 show different stages in the manufacture of an underwater structure according to the invention, and FIG. 4 is an enlarged view of a detail of FIG. 2.

Referring to the drawings, the first stage in the manufacture of the underwater structure, (see FIG. 1), is to float an assembly consisting of a structural unit 10 and prefabricated impervious membrane 12 to the site where the underwater structure is to be formed; the member is secured in water tight fashion to the lower periphery of the unit and is in a folded condition during travel to the site. At the site, the assembly is held in position by sea anchors, water is then pumped into the membrane to inflate it and to cause its base portion to rest on a bed 14 of the sea or river in which the underwater structure is to be formed. Three concentric casings 16, 18 and 20 (see FIG. 2) are then inserted through a bore 22 provided in unit 10 and lowered until their lower ends are located adjacent the membrane base. The innermost casing 16 is perforate and the outer two casings 18 and 20 are imperforate, there being an annular seal 24 secured at the lower inner surface of casing 18 and sealingly engaging the outer periphery of casing 16. A coarse sand and water mixture is next pumped down the annular bore formed between casing 18 and 20, to provide on the membrane base a drainage layer 28 of coarse sand. When layer 28 has reached a sufficient thickness, the coarse sand in the pumped sand/water mixture is replaced by a finer sand to build up a sand layer 30 on top of layer 28. Further alternate layers of coarse sand and fine sand are then deposited until the membrane is filled to the required level. During the pumping operation, water draining from the sand layers into casing 16 through its perforate walls is drawn up the casing and away from the composite coherent body of sand through a suitable pump conduit 32. As the upper level of the body increases so the outer two casings 18 and 20 are raised to maintain their lower ends adjacent the upper level.

When the membrane is filled to the desired level, the unit 10 is sunk on top of the sand body (see FIG. 3) and outer casings 18 and 20 are removed leaving inner casing which with the aid of the above mentioned pump continues to carry away water drained from the body of sand filling the membrane; the drainage layers 28 assist in this drainage.

By drawing the water from the body of sand, build up of pore water pressure in the sand is reduced and this in turn maintains at a suitable level the internal shear strength of the partially drained sand body under the confinement of the natural hydrostatic pressure acting on the outside of the membrane, thereby enabling the underwater structure to support unit 10 which provides an above water temporary or permanent working area; or which may be used to create an island or breakwater.

It will be apparent that instead of sand, other suitably particulate materials may be used and that one or more perforate casings may be used to drain the body of sand.

Although we have illustrated a conical shaped membrane other shapes may be used such as cylindrical and hyperbolic shapes.

The structural unit 10 may be fabricated for use as an oil drilling rig in which case the unit will be provided with living quarters, workshops, oil drilling ducts and storage areas for fresh water and possibly oil.

It is envisaged that the above described underwater structure is suitable for water depths up to 1000 feet.

I claim:

1. A method of forming an underwater structure, comprising the steps of attaching an impervious membrane to the periphery of a floatable structural unit to form an assembly defining a closed container; extending the membrane from a folded to an extended condition, when the assembly is positioned at the site where the underwater structure is to be formed to cause a base portion of the membrane to rest on the river or sea bed; filling the membrane with a body of non-settable particulate material; draining the particulate body to enable the external water pressure to exert a confining pressure on the body to render it coherent; and supporting said structural unit on the coherent particulate body.

2. The method of claim 1 wherein the member is extended by pumping water into the membrane to inflate it.

3. The method of claim 1, wherein the particulate body is formed by pumping a slurry comprising a particulate material and water mixture into the membrane, and then withdrawing the water from the body.

4. The method of claim 3, wherein the articulate body is built up from alternate layers of a finer and a coarser particulate material, the layers of coarser particulate material being provided to assist in draining the particulate body.

5. The method of claim 3, wherein the particulate material and water mixture is fed through an outer one of two concentric pipes lowered into the membrane, wherein the water is withdrawn through the inner pipe which is perforate and wherein the outer pipe is raised during the body forming operation to maintain the lower end of the pipe adjacent to the upper level of the body.

6. The method of claim 1, wherein the assembly is floated to the site with the membrane is a folded condition.

* * * * *